United States Patent [19]

Nicholson

[11] 4,327,824

[45] May 4, 1982

[54] CHEAT PREVENTING DEVICE FOR COIN MACHINES

[75] Inventor: Raymond W. Nicholson, Bensenville, Ill.

[73] Assignee: Coin Mechanisms, Inc., Elmhurst, Ill.

[21] Appl. No.: 156,280

[22] Filed: Jun. 4, 1980

[51] Int. Cl.[3] ..... G07F 3/02

[52] U.S. Cl. ..... 194/9 R

[58] Field of Search ..... 194/9, 97 R, 97 B, 102, 194/99

[56] References Cited

U.S. PATENT DOCUMENTS 773,405 10/1904 Meyer ..... 194/97 R 3,279,574 10/1966 Seiden ..... 194/97 R

*Primary Examiner*—Stanley H. Tollberg

[57] ABSTRACT

In the part of the passageway leading out of a coin testing apparatus is an L-shaped member comprising an upright leg and a generally horizontal foot which lies in a plane coincident with the thickness (narrow dimension) of the passageway. The leg is suspended for pivotal movement about an axis normal to that plane and the foot projects into the passageway to be contacted by a selected coin descending through the passageway, which coin would thereby cause the member to pivot with the coin thereby being permitted to continue to descend. The foot is sufficiently close above the actuating arm of an electrical switch that, if a tethered coin descends below the member sufficiently far to move the arm to switch actuating position, the foot will then have pivoted back into the passageway and will prevent the coin from being raised to a level at which the switch arm is returned to switch-deactuated position.

5 Claims, 4 Drawing Figures

CHEAT PREVENTING DEVICE FOR COIN MACHINES

BACKGROUND AND SUMMARY OF THE INVENTION

The present invention relates to an anticheat device used on a coin testing apparatus. Coin testing apparatus is employed on various coin operated machines, such as a pinball machine. Such apparatus distinguishes between coins of various denominations, and slugs, and only permits a coin of a selected denomination, e.g., a quarter, to operate an electrical switch which activates the machine. One procedure for cheating such apparatus is to affix a tether to a coin of the proper denomination. The coin is allowed to descend through the apparatus and after reaching and actuating the electrical switch the coin is pulled up by its tether to an elevation above the electrical switch arm so that it can be allowed to descend a second time (and numerous times thereafter) for a subsequent actuation of the switch and use of machine without additional payment therefor. Various anticheat devices are known for attempting to stop such cheating of the apparatus by this practice of "stringing" a coin.

The principal object of the present invention is to provide a simple and foolproof anticheating device against such stringing practice. Its simplicity is such that it adds little to the cost of a coin testing device.

The closest prior art anticheat device known to me is represented by U.S. Pat. No. 3,627,094. This device comprises a gate which extends transversely across the thickness (narrow dimension) of the coin passageway and is pivoted about an axis which is parallel to a plane coincident with that passageway thickness. In contrast to this, the device of the present invention lies in said plane, coincident with the thickness of the passageway, and is pivoted about an axis normal to that plane. Thus in the present invention the device comprises an L-shaped member formed by a generally upright leg and a generally horizontal foot. Intermediate the upper and lower ends is the pivotal axis and the foot extends from the lower end of the leg into the passageway from one side thereof. Thus when a coin descends against the foot, not only does the coin push the foot out of the passageway sufficiently to permit the coin to pass thereby, but also the foot urges the coin toward the opposite side of the passageway. Thus if the coin is of a smaller denomination, and thus smaller in diameter, the coin will be at the opposite side of the passageway where it can pass the actuating arm of the electrical switch without displacing that arm sufficiently to actuate the switch. There are instances in which the coin testing apparatus will permit (perhaps because of a defrauding action by the individual inserting the coin) a lower denomination coin to enter the part of the passageway at which the switch arm is located. If that occurs with an anticheating device of the type represented by U.S. Pat. No. 3,627,094, that smaller denomination coin will actuate the switch. With an anticheating device of the present invention the smaller denomination coin will be positioned to substantially avoid the switch arm and thus fail to activate the machine.

Other objects and advantages will become apparent from the following description taken in conjunction with the drawing.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
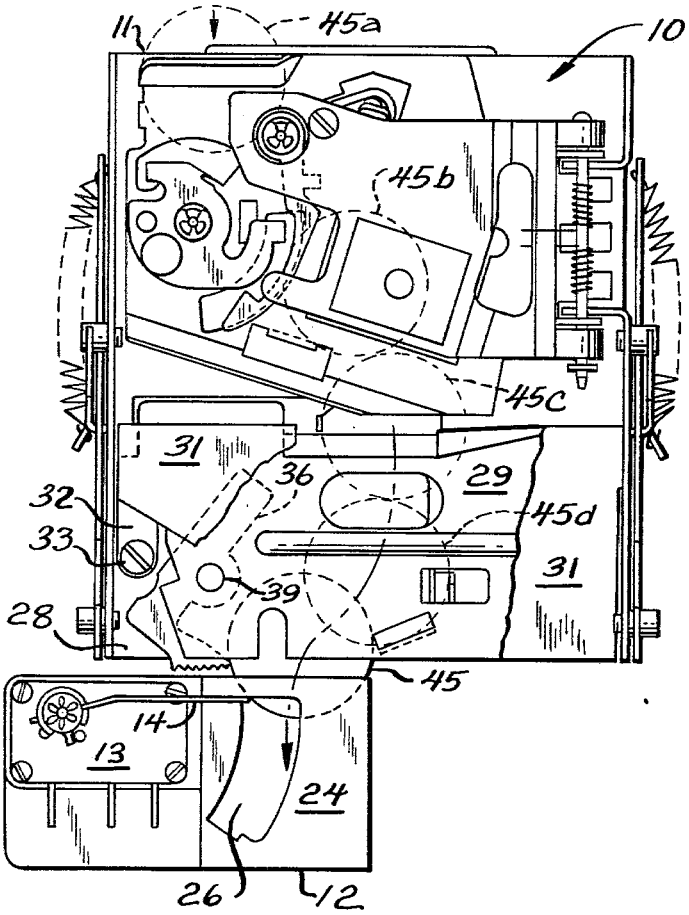
FIG. 1 is an elevational view, partially broken away, of a coin testing apparatus incorporating an anticheating device of the present invention.

The drawing illustrates a coin testing apparatus, generally 10, of prior art construction and known in the art. Its purpose is to distinguish between quarters on the one hand and, on the other hand, slugs and coins of a lower denomination. It has a passageway through which the quarters will pass, which passageway commences with an inlet 11 and ends with an outlet 12. Of course, all coins are inserted into the same inlet, but due to details of the mechanism which are unimportant to the present invention, other coins and slugs follow different routes and have a different outlet. The passageway followed by the quarters can generally be seen by the positions of the various dashed line circles in FIG. 1, which dashed line circles represent successive positions of a quarter as it moves through the mechanism. Just before the quarter reaches the passageway outlet it actuates an electrical switch 13 by moving the switch arm 14 downwardly as the quarter first engages it, depresses it and then moves past it. Without an anticheating device a quarter 16 suspended by a tether 17, in the form of a polyester thread, a nylon line, etc., can be permitted to descend sufficiently to actuate switch 13 without being permitted to completely pass switch arm 14. Upon switch 13 being actuated the quarter is raised, by means of drawing up on the tether, to an elevation above the switch arm (which returns upwardly by reason of an internal biasing spring in the switch). Thereafter, the quarter can again be lowered sufficiently to actuate the switch and this action repeated numerous times without the necessity of depositing a succession of quarters into the coin operated machine of which the apparatus is a part.

Immediately above the outlet 12 of the quarter passageway is a part 18 thereof which is defined by a first pair of side walls 21 and 22 and a second pair of side walls 23 and 24. Side walls 21 and 22 are spaced apart a distance only slightly greater than the width (diameter) of the quarter, and side walls 23 and 24 are spaced apart a distance only slightly greater than the quarter's thickness, thus accordingly defining the dimensions of part 18 of the passageway. Side walls 23 and 24 are provided with openings 26 to allow the distal end 27 of the switch arm 14 to project into the passageway part 18. Even with the switch arm 14 in the raised, switch-deactuated position illustrated in FIG. 1, the distal end 27 is sufficiently close to side 21 that a penny can move through the part of the passageway which is between the distal end of the switch arm and wall 22 without the switch arm being depressed sufficiently to actuate switch 13.

Immediately above the passageway part 18, the thickness of the quarter passageway is defined by a back (or main) plate 28 and an intermediate plate 29. There is an outer plate 31 which, together with intermediate plate 29, forms the passageway through which coins of other denominations will pass. This outer plate 31 has an ear 32 which abuts the back plate 28 and is affixed thereto by means of a screw 33. A wall 34 (extending perpendicular to the plane of the paper of the drawings) connects ear 32 and the outer plate 31.

Figure 3:
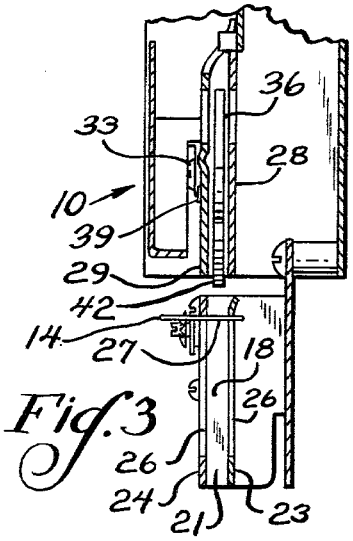
FIG. 3 is a section transverse to the coin passageway and illustrating the position of the anticheat device of the present invention in that passageway.
Figure 2:
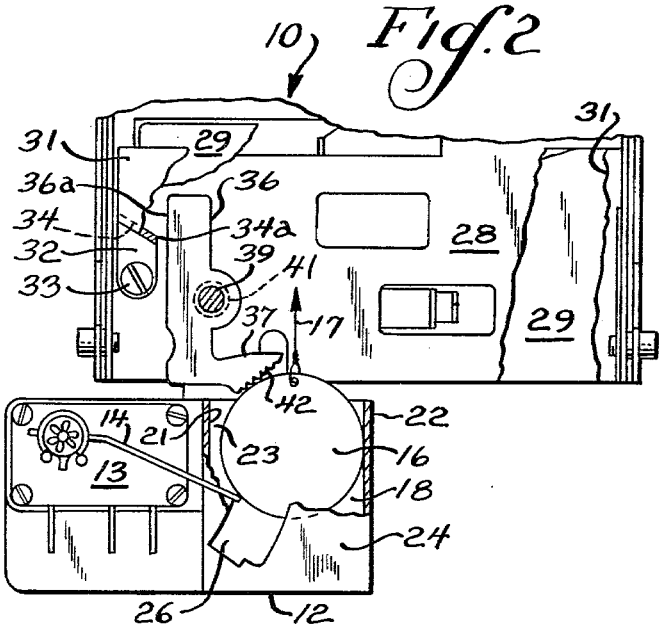
FIG. 2 shows a part of the apparatus, as viewed in FIG. 1, but with additional portions broken away.
Figure 4:
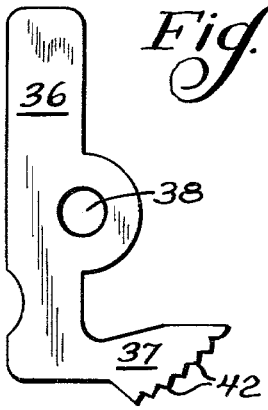
FIG. 4 is an elevational view of the L-shaped member employed in the anticheat device of the present invention.

The anticheat device of the present invention includes an L-shaped member (seen in FIG. 4) comprising an upright leg 36 and a foot 37 at the bottom of the leg. Intermediate the upper and lower ends of the leg is an opening 38 to receive a pivot pin 39. Pivot pin 39 has a head 41 adjacent the back plate 28 and is swaged to the intermediate plate 29. In the normal position the leg 36 is substantially vertical while the foot 37 is substantially horizontal, approximately as seen in FIG. 2. The distal end of the foot has a plurality of serrations 42 on the lower side thereof. The pivotal axis defined by pin 39 is approximately vertically above side 21 of passageway part 18. As best seen in FIG. 3, the L-shaped member is planar with the plane thereof coinciding with the plane defined between plates 28 and 29 which establish the thickness of the portion of the passageway immediately above passageway part 18. The distal end of the foot 37 projects sufficiently close to wall 22 that coins will not pass therebetween when the member is in the normal, FIG. 2, position.

When, as illustrated at the dashed line 45*a*, a quarter 45 is dropped into the passageway inlet 11 it descends through the quarter passageway as generally illustrated by the successive positions 45*b*, 45*c* and 45*d*. As the quarter approaches the position illustrated by the position of quarter 45 in FIG. 1, it contacts the top of foot 37 and the weight of the quarter rotates the L-shaped member in a clockwise direction from the position generally illustrated in FIG. 2 toward, and beyond, the position illustrated in FIG. 1. In this manner the L-shaped member moves out of the quarter's path allowing the quarter to descend through part 18 of the passageway. As the quarter moves through this part of the passageway it engages the distal end 27 of the switch arm and rotates the switch arm from the FIG. 1 position to, and beyond, the position illustrated in FIG. 2. This actuates the switch 13 and thus energizes the machine of which the coin testing apparatus is a part. The coin then drops from the outlet 12 of the passageway and into a suitable receptacle, not shown. With the quarter out of the way, the internal biasing spring of switch 13 (a conventional snap-action switch) returns the switch arm to the FIG. 1 position. Also, the L-shaped member will have again rotated to approximately the FIG. 2 position by reason of the fact that the center of gravity thereof is below the axis of pivot pin 39 or the left side of the pivot pin when the member is in the displaced position to allow the quarter to move past it.

If a stringed or tethered quarter 16 is inserted into inlet 11 it will follow the same path. Assuming that someone is attempting to cheat the machine and allow the quarter to descend in the passageway only sufficiently far to actuate switch 13 (the position of the quarter 16 at that time being only a little bit below the position illustrated in FIG. 2) and then raise the quarter by means of its tether to an elevation such that the switch arm will be sufficiently close to the position illustrated in FIG. 1 to permit the switch 13 to deactuate, this will be prevented by the anticheat device of the present invention. Thus as that person raises the quarter 16 through the passageway portion 18 (raised from the quarter's position when switch 13 is actuated), the upward movement of the quarter will be blocked by the foot 37 as illustrated in FIG. 2. The quarter becomes wedged between serrations 42 and the wall 22. In most instances, the engagement of the serrations and the rim of the quarter will be sufficient to prevent further counterclockwise rotation of the L-shaped member beyond the position illustrated in FIG. 2. However, should such further rotation occur, the side 36*a* of the leg of the member will engage side 34*a* of the wall 34 to prevent further counterclockwise rotation of the member, the wall 34 thus acting as a stop. In such position of the member there still is insufficient room between the distal end of foot 37 and the wall 22 to permit upward movement of the quarter 16. Some manufacturers may prefer to dispense with serrations 42 and merely utilize a stop (wall 34) as a means of causing the member to block the upward movement of the quarter 16. With the switch arm 14 raised only to the FIG. 2 position, the switch 13 has not yet been deactuated. The switch arm must more closely approach the FIG. 1 position before the switch 13 becomes deactuated.

If, as occasionally happens, perhaps by appropriate manipulation, a coin of a smaller denomination (say a penny) moves toward the passageway portion 18, it will also contact the top of foot 37 to cause the clockwise rotation of the L-shaped member. As this occurs, the top of the foot acts as a cam urging that smaller coin over to wall 22, i.e., into that portion of the passageway part 18 remote from distal end 27 of the switch arm. With the smaller coin descending through that portion of the passageway part 18, the coin does not engage the distal end 27 sufficiently to move the switch arm 14 to its fully lowered position necessary to actuate switch 13.

I claim:

1. In a testing apparatus for coins of given thickness and width dimensions, said device having a coin inlet, a coin outlet, passageway means for coins extending between said inlet and outlet, said passageway means including a portion adjacent said outlet which has thickness and width horizontal dimensions only slightly larger than the dimensions of the coin thereby confining such a coin as it moves downwardly through said portion, electric switch means having an actuating arm with a distal end in said portion to be contacted by a coin moving through said portion, said arm having a normal position at which it is in the path of downward movement of said coin through said portion with said coin then displacing the distal end downwardly to a displaced position at which the switch is actuated to signify the passage of the coin, said arm being returned to said normal position after the coin has passed with the switch means returning to its unactuated condition as the arm, in its return, reaches a location adjacent said normal position, and an anti-cheat device immediately above said portion to prevent a tethered coin which was descended sufficiently far through said portion to move said end to said displaced position from thereafter being raised to said location, said anti-cheat device being mounted for pivotal movement about an axis to permit a coin to move past is as the coin descends through the passageway means toward said portion, the improvement wherein said anti-cheat device comprises:

an L-shaped member having a generally upright leg with a lower end and a generally horizontal foot at said lower end of the leg, said leg and foot being positioned in a common plane, which plane is coincident with the thickness of the passageway means portion, said pivotal axis being above said foot, extending through said leg and being normal to said plane, said foot extending transversely from said leg into the path of downward movement of said coin, said leg remaining out of the path of downward movement of said coin.

2. In an apparatus as set forth in claim 1, wherein the width of said portion is somewhat greater than the width of another coin of a lower denomination than that of the first mentioned coin, the further improvement comprising:

said portion of the passageway means having two sides defining said width thereof, said distal end being sufficiently close to one of said sides to permit said other coin to descend along the other of said sides without actuating the switch, said member being positioned with said leg and axis generally above said one side with the foot projecting into the passageway means generally in the direction toward said other side, whereby a coin descending onto said foot will be urged toward said other side so that if the descending coin is one of said lower denomination it will thereby be in a position to fail to actuate said switch.

3. In an apparatus as set forth in claim 2, wherein the foot has a distal end which is serrated, and is closer to said other side than the width of the first mentioned coin, and including stop means positioned to contact said member when said foot is substantially in the generally horizontal position to prevent said member from further rotating in a direction such that said foot would be further raised.

4. In an apparatus as set forth in claim 1, wherein said portion of said passageway means has two sides defining said width thereof, and wherein said member is positioned with said leg and said axis generally above said one side with the foot projecting into the passageway means generally in the direction toward the other of the sides, the foot has a distal end which is serrated, and is closer to said other side than the width of the coin.

5. In an apparatus as set forth in claim 1, wherein said portion of said passageway means has two sides defining said width thereof, wherein said member is positioned with said leg and said axis generally above said one side with the foot projecting into the passageway means generally in the direction toward the other of the sides, the foot has a distal end which is closer to said other side than the width of the coin, and including stop means positioned to contact said member when said foot is substantially in the generally horizontal position to prevent said member from further rotating in a direction such that said foot would be further raised.

* * * * *